US006902635B2

(12) United States Patent
Korwin et al.

(10) Patent No.: US 6,902,635 B2
(45) Date of Patent: Jun. 7, 2005

(54) MULTI-CELL THERMAL PROCESSING UNIT

(75) Inventors: Michel J. Korwin, Westmount (CA); Janusz Szymborski, Pointe Claire (CA)

(73) Assignee: Nitrex Metal Inc., St. Laurent (CA)

( * ) Notice: Subject to any disclaimer, the term of this patent is extended or adjusted under 35 U.S.C. 154(b) by 189 days.

(21) Appl. No.: 10/025,503

(22) Filed: Dec. 26, 2001

(65) Prior Publication Data

US 2003/0116894 A1 Jun. 26, 2003

(51) Int. Cl.[7] ..... C21D 10/00
(52) U.S. Cl. ..... 148/559; 266/78; 266/252
(58) Field of Search ..... 266/44, 78, 252, 266/249; 148/559; 432/230, 207

(56) References Cited

U.S. PATENT DOCUMENTS

| | | | | | |
|---|---|---|---|---|---|
| 2,000,664 | A | * | 5/1935 | Hayes | 432/207 |
| 3,598,381 | A | | 8/1971 | Schwalm et al. | |
| 3,662,996 | A | | 5/1972 | Schwalm et al. | |
| 3,926,415 | A | | 12/1975 | Konas et al. | |
| 4,653,732 | A | | 3/1987 | Wunning et al. | |
| 4,763,880 | A | | 8/1988 | Smith et al. | |
| 4,951,601 | A | * | 8/1990 | Maydan et al. | 118/719 |
| 5,052,923 | A | | 10/1991 | Peter et al. | |
| 5,868,871 | A | * | 2/1999 | Yokose et al. | 266/252 |
| 6,065,964 | A | | 5/2000 | Pelissier | |
| 2001/0015074 | A1 | * | 8/2001 | Hosokawa | 62/378 |

FOREIGN PATENT DOCUMENTS

| | | |
|---|---|---|
| EP | 1 193 317 | 4/2002 |
| EP | 1 229 137 | 8/2002 |
| JP | 08 178 535 | 7/1996 |

OTHER PUBLICATIONS

English language translation of Japanese 08 178535, Dec. 7, 1996.*

Czelusniak et al., "NITREG; NITREG–ONC; NITREG–S; advanced surface hardening technologies for steel through nitrogen implantation", Nitrex Metal Inc., St–Laurent, Quebec, Canada, no date.

* cited by examiner

*Primary Examiner*—Scott Kastler
(74) *Attorney, Agent, or Firm*—Freedman & Associates

(57) ABSTRACT

The present invention relates to a multi cell thermal processing unit. The thermal processing unit comprises an air tight common chamber containing an atmosphere other than ambient air. A loading cell is linked to the common chamber via a gas tight door for providing to and receiving from the common chamber a workpiece. Further, a preheating cell is linked to the common chamber via a heat insulating door. The preheating cell provides a substantially fixed temperature for activating the workpiece. Thermochemical processing of the workpiece is provided by a first and a second thermochemical processing cell each linked to the common chamber via a heat insulating door. The first thermochemical processing cell provides substantially fixed first thermochemical processing conditions for nitriding the workpiece. The second thermochemical processing cell provides substantially fixed second thermochemical processing conditions for post nitriding treatment of the workpiece. A cooling cell linked to the common chamber provides controlled cooling of the workpiece. The thermal processing unit according to the invention, wherein thermochemical processing cells are operated under substantially constant conditions considerably facilitates control functions for providing predetermined conditions. This allows a substantially more accurate control of the thermochemical processing conditions which is especially advantageous for reproducibly thermochemical processing workpieces using nitriding processes.

30 Claims, 11 Drawing Sheets

MULTI-CELL THERMAL PROCESSING UNIT

FIELD OF THE INVENTION

This invention relates to thermal processing of workpieces and in particular to a multi-cell thermal processing unit comprising a plurality of thermochemical processing cells, wherein each cell is operated at a substantially fixed predetermined atmosphere and temperature.

BACKGROUND OF THE INVENTION

Heat treating of metal is a commonly used technique to improve material characteristics of a workpiece for specific applications. For example, surface hardening involving a change in the composition of the outer layer of an iron-base alloy through application of an appropriate thermal treatment. Typical processes are carburizing carbo-nitriding and nitriding. Application of such processes enhances wear resistance, corrosion resistance, and fatigue strength of such treated workpieces. Other heat treatment processes involve annealing and aging.

However, in order to reproducibly obtain predetermined results using these surface hardening processes control of operating parameters such as composition of the atmosphere, temperature, and pressure during the hardening process is required. This is particularly necessary for nitriding processes. From the control point of view nitriding is a very complex process influenced by thermodynamic relations at the gas/metal interface during breakup of the atmosphere's components. The exact nature of the reactions taking place, i.e. mass transport of the gaseous phase, adsorption, diffusion and nitride phase formation is determined by the kinetics of this process. In order to control this process accurate provision of the atmosphere's components as well as temperature and pressure are essential.

Normally, a heat treating process of a workpiece comprises a number of processing steps such as preheating, carburizing or nitriding, and cooling or quenching. Numerous prior art systems have been disclosed teaching cascading of various chambers for preheating, thermal treating and cooling in order to avoid, for example, cooling of the nitriding furnace for loading and unloading of a batch of workpieces. Such systems are disclosed, for example, in U.S. Pat. No. 3,598,381 issued to Schwalm et al. in Aug. 10, 1971, U.S. Pat. No. 3,662,996 issued to Schwalm et al. in May 16, 1972, U.S. Pat. No. 4,653,732 issued to Wunning et al. in Mar. 31, 1987, U.S. Pat. No. 4,763,880 issued to Smith et al. in Aug. 16, 1988, and U.S. Pat. No. 5,052,923 issued to Peter et al. in Oct. 1, 1991, which are incorporated hereby for reference.

However, these systems are very inefficient for modern applications. Nowadays, use of thermal processing of metal workpieces in order to improve their material characteristics is numerous. This results in an increasing demand of a plurality of differently treated workpieces meeting different material characteristic requirements. The above mentioned heat treating systems only allow treatment of workpieces using a same process. Furthermore, change of thermochemical processing parameters such as atmosphere composition or temperature for different workpieces requires change of the operating parameters of the heat treating cell of the system. Therefore, a complex heat treating cell being able to provide numerous different heat treating parameters is required. Additionally, change of the heat treating parameters requires a substantial amount of time for adjusting the heat treating cell, which is not acceptable in modern manufacturing processes. Another disadvantage of these prior art systems is the inefficient use of the various system components through the cascading of these components. For example, the thermochemical processing step requires substantially more time than the cooling or quenching step. Thus, during the thermochemical processing step the cooling or quenching cell is sitting idle.

However, it would be advantageous for modern manufacturing applications to divide the thermal process into steps performed under substantially fixed conditions or performed within a narrow range of conditions based on the different processing steps required for the different heat treating of workpieces. Manufacturing and operating costs would be substantially reduced if each of the processing modules is operated at substantially fixed parameters such as atmosphere composition and temperature.

It is, therefore, an object of the invention to provide a method for thermal processing workpieces by dividing the thermal process into steps performed under substantially fixed conditions or performed within a narrow range of conditions based on the different processing steps required for the different heat treating of workpieces.

It is further an object of the invention to provide a multi-cell thermal processing unit wherein each of the processing cells is operated at substantially fixed operating parameters.

SUMMARY OF THE INVENTION

The multi-cell thermal processing units according to the invention are highly advantageous for modem thermochemical processing applications. For example, keeping the operating conditions in each of the thermochemical processing cells constant or varying these conditions only within a range smaller than the range required for a complete thermochemical processing process provides considerable time as well as energy savings. Furthermore, operating a thermochemical processing cell under substantially constant conditions considerably facilitates control functions for providing predetermined conditions. This allows a substantially more accurate control of the heat thermochemical processing conditions which is especially advantageous for reproducibly thermochemical processing workpieces using nitriding processes such as the NITREG® process.

In accordance with the present invention there is provided a multi cell thermal processing unit comprising:

an air tight expandable common chamber module for containing an atmosphere other than ambient air, the chamber module comprising N ports;

a loading cell linked to the first port of the common chamber module via a gas tight door for providing to and receiving from the common chamber module a first and a second workpiece;

a first thermochemical processing cell linked to the second port of the common chamber module via a heat insulating door, the first thermochemical processing cell for providing substantially fixed first thermochemical processing conditions for thermochemical processing the first workpiece;

a second thermochemical processing cell linked to the third port of the common chamber module via a heat insulating door, the second thermochemical processing cell for providing substantially fixed second thermochemical processing conditions for thermochemical processing the second workpiece;

a transport mechanism disposed within the common chamber module for handling and transporting the first and the second workpiece within the thermal processing unit; and, N-3 sealing covers for airtightly sealing the remaining N-3 ports, the covers being removable for mating the common chamber module to a processing cell or another common chamber module.

In accordance with the present invention there is further provided a multi cell thermal processing unit comprising:

an air tight common chamber for containing an atmosphere other than ambient air;

a loading cell linked to the common chamber via a gas tight door for providing to and receiving from the common chamber a workpiece;

a first thermochemical processing cell linked to the common chamber via a heat insulating door, the first thermochemical processing cell for providing substantially fixed first thermochemical processing conditions for nitriding the workpiece;

a second thermochemical processing cell linked to the common chamber via a heat insulating door, the second thermochemical processing cell for providing substantially fixed second thermochemical processing conditions for second nitriding treatment of the workpiece;

a cooling cell linked to the common chamber for controllably cooling the workpiece; and, a transport mechanism disposed within the common chamber for handling and transporting the first and the second workpiece within the thermal processing unit.

In accordance with the present invention there is yet further provided a multi cell thermal processing unit comprising:

an air tight common chamber for containing an atmosphere other than ambient air;

a loading cell linked to the common chamber via a gas tight door for providing to and receiving from the common chamber a first and a second workpiece;

a preheating cell linked to the common chamber via a heat insulating door, the preheating cell for providing a substantially fixed temperature for activating the workpiece;

a first thermochemical processing cell linked to the common chamber via a heat insulating door, the first thermochemical processing cell for providing substantially fixed first thermochemical processing conditions for thermochemical processing the first workpiece;

a second thermochemical processing cell linked to the common chamber via a heat insulating door, the second thermochemical processing cell for providing substantially fixed second thermochemical processing conditions for thermochemical processing the second workpiece; and, a transport mechanism disposed within the common chamber for handling and transporting the first and the second workpiece within the thermal processing unit.

In accordance with the present invention there is yet further provided a multi cell thermal processing unit comprising:

an air tight common chamber for containing an atmosphere substantially comprising an inert gas;

a loading cell linked to the common chamber via a gas tight door for providing to and receiving from the common chamber a workpiece;

a preheating cell linked to the common chamber via a heat insulating door, the preheating cell for providing a substantially fixed temperature for heating the workpiece to a predetermined temperature;

a first thermochemical processing cell linked to the common chamber, the first thermochemical processing cell for providing a first portion of thermochemical processing conditions of a thermochemical processing process for thermochemical processing the workpiece;

a second thermochemical processing cell linked to the common chamber, the second thermochemical processing cell for providing a second portion of the thermochemical processing conditions of the thermochemical processing process for thermochemical processing the workpiece; and, a transport mechanism disposed within the common chamber for handling and transporting the workpiece within the thermal processing unit.

In accordance with an aspect of the present invention there is provided a method for thermal processing a workpiece comprising the steps of:

providing a first workpiece to a first thermochemical processing cell linked to a common chamber containing an atmosphere other than ambient air;

thermochemical processing the first workpiece by providing a first portion of thermochemical processing conditions of a first thermochemical process;

transferring via the common chamber the first workpiece from the first thermochemical processing cell to a second thermochemical processing cell linked to the common chamber after elapse of a first predetermined time interval;

thermochemical processing the first workpiece by providing a second portion of the thermochemical processing conditions of the first thermochemical processing process; and, removing the first workpiece from the second thermochemical processing cell after elapse of a second predetermined time interval.

BRIEF DESCRIPTION OF THE FIGURES

Exemplary embodiments of the invention will now be described in conjunction with the following drawings, in which.

DETAILED DESCRIPTION OF THE INVENTION

In the following description the expression workpiece is used to refer to any kind of manufactured metallic component such as springs, valves, piston rings, etc. for thermal processing. Furthermore, the expression workpiece also includes a batch of components, which are treated together and are provided, for example, in a racking. Moreover, a complete process including steps such as preheating, thermochemical processing, quenching etc. is called thermal processing. Whereas, the expression thermochemical processing includes only operations combining the effects of heat and of an active atmosphere such as nitriding, carburizing, nitro-carburizing, or comparable processing steps.

Some of these drawbacks of the prior art are overcome by the thermal processing installation disclosed by Pelissier in U.S. Pat. No. 6,065,964 issued in May 23, 2000. Pelissier teaches a vaccum thermal processing installation for use under a rarefied atmosphere including several processing cells linked to a common air-tight vacuum chamber. By feeding all workpieces through a common vaccum chamber, improved vaccum conditions are achievable within each oven chamber. This has specific advantages to vacuum thermochemical processes, but is of little or no advantage to a nitriding process wherein increased vacuum quality of successive chambers is not necessary. Though, the system of Pelissier, appears similar to the system described herein, it is a system that would not have been considered with foresight in looking toward the inventive solution since, nitriding does not require improved vacuum atmosphere quality. That said, Pelissier does teach a single common low pressure atmosphere chamber for use in loading and unloading of workpieces into ovens for independent processing therein. The main advantage of this installation is the use of only two air-tight doors for operating a plurality of processing cells and a gas quenching cell linked to the common chamber, thus reducing manufacturing costs and improving manufacturing quality.

In order to provide a better understanding of the invention, flow diagrams illustrating processing steps and their possible interconnection during operation of prior art systems will be described first, followed by a comparison with flow diagrams illustrating possible processing flows using the thermal processing unit according to the invention.

Figure 1:
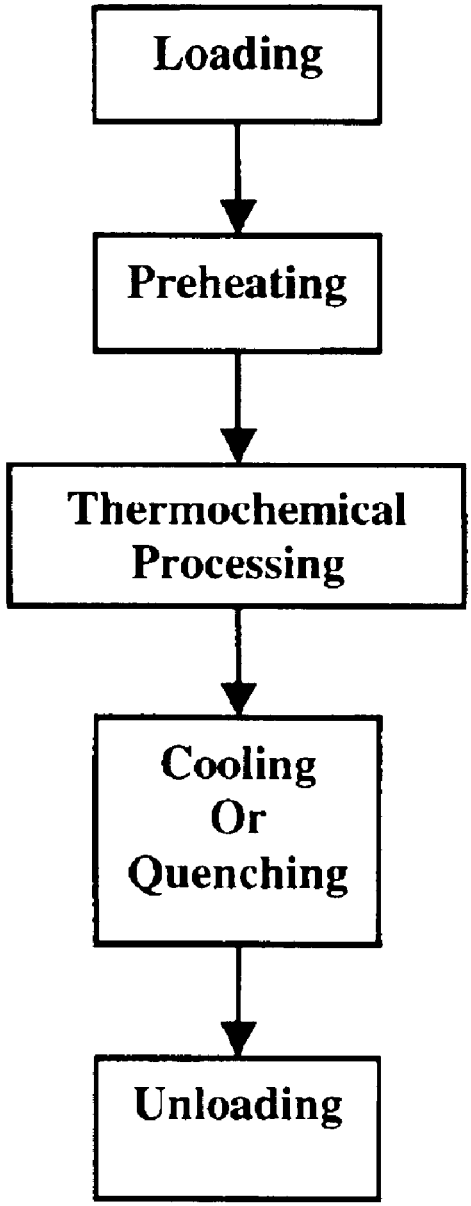
Fig. 1 Prior Art
FIG. 1 is a simplified flow diagram illustrating a processing flow for prior art thermal processing systems.

Referring to FIG. 1 a processing flow for prior art thermal processing systems having a cascaded arrangement of a loading cell, a preheat cell, a thermochemical processing cell, and a cooling or quenching cell is shown. Such systems are now widely used in the industry for the thermal processing of workpieces. As shown in the diagram these systems are very inflexible in their operation. For example, they allow application of only one process having one set of predetermined operating conditions such as atmosphere composition, temperature, pressure. For thermally processing a workpiece requiring a process with a different set of parameters the whole system has to be adapted for this process. This is especially inefficient if the number of workpieces requiring this set of parameters is small. Furthermore, use of some components of the system is always inefficient. For example, the step of thermochemical processing requires substantially more time than the step of quenching. Therefore, due to the cascading of the system components the quenching cell is not in use most of the time. Another disadvantage of such systems is an insufficient adaptability to the amount of workpieces to be processed. If the amount exceeds the capacity of such a system a whole system comprising all the components has to be installed.

Figure 2:
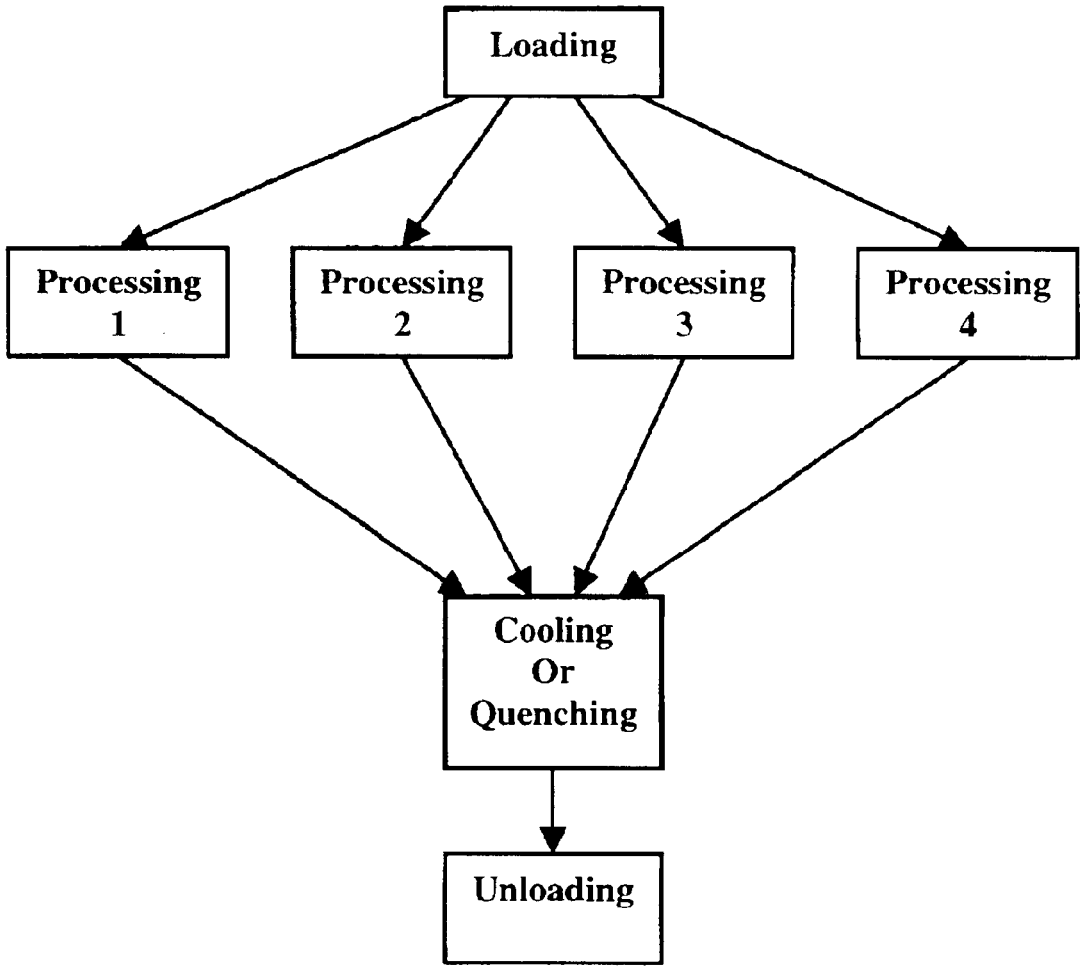
Fig. 2 Prior Art
FIG. 2 is a simplified flow diagram illustrating a processing flow for prior art thermal processing systems.

An improvement of the above prior art systems is obtained using the system disclosed by Pelissier in U.S. Pat. No. 6,065,964 and shown in the flow diagram of FIG. 2. Linking a plurality of thermochemical processing cells, a loading cell and a quenching cell to common chamber provides increased flexibility. Here, one loading cell and one quenching cell are used to serve a plurality of thermochemical processing cells resulting in a more efficient use of the loading and the quenching cell. It allows parallel operation of the thermochemical processing cells and, for example, use of the loading cell and the quenching cell while at a same time workpieces are processed in some of the thermochemical processing cells. Furthermore, it allows expansion of the system by just adding the required components.

Figure 3A:
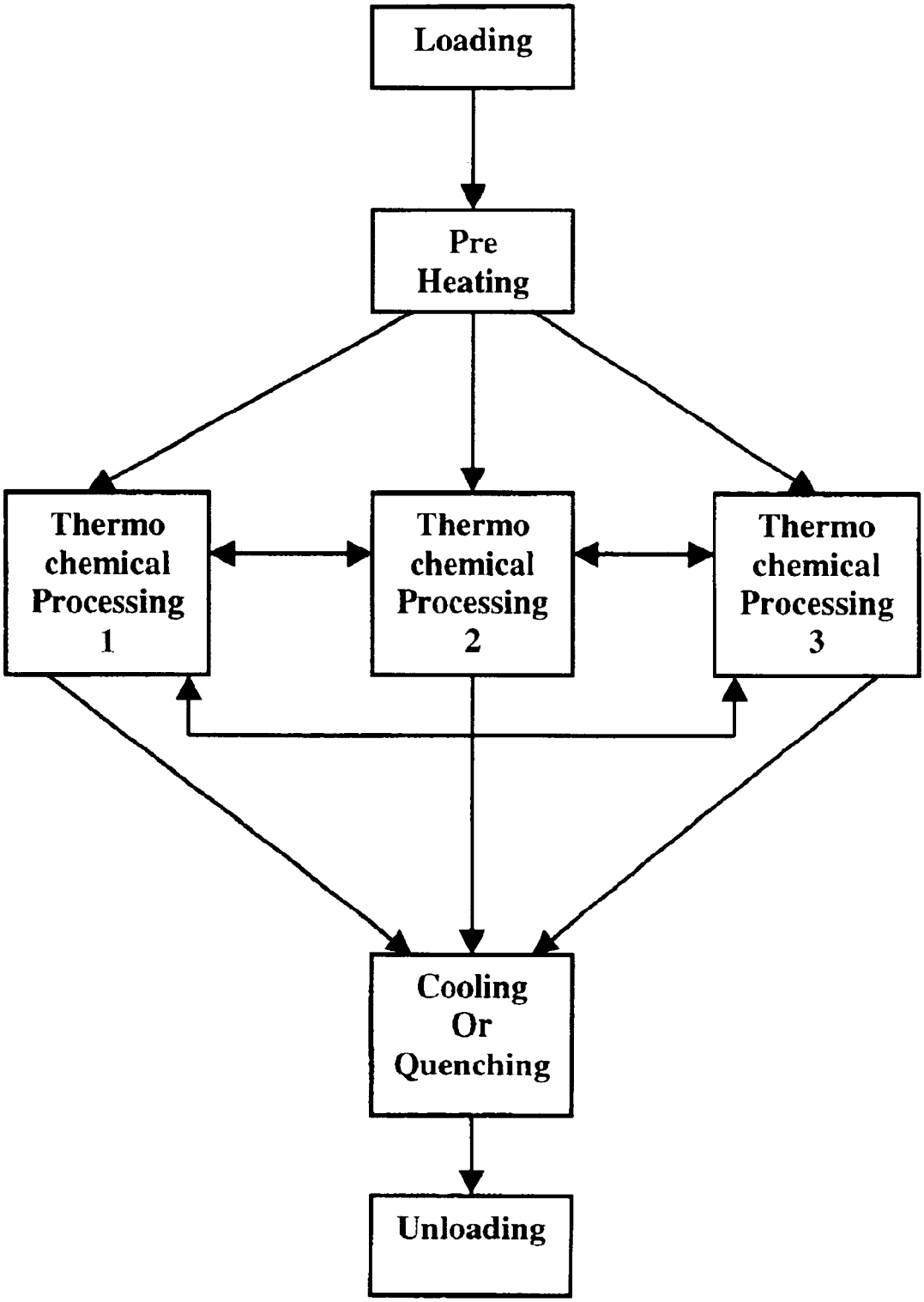
FIG. 3*a* is a simplified flow diagram of a method for thermal processing according to the invention.

Referring to FIG. 3*a* a simplified flow diagram of a method for thermal processing according to the invention is shown. Here, as compared to the diagram shown in FIG. 2 the processing flow is divided into a preheat step and a plurality of parallel thermochemical processing steps. Workpieces are preheated in a preheat cell and then transferred into one of a plurality of thermochemical processing cells. Each of the thermochemical processing steps is conducted using a thermochemical processing cell having a substantially fixed predetermined atmosphere composition, temperature and pressure. Alternatively, atmosphere composition, temperature and/or pressure are changed within a predetermined range being a portion of the range of operating conditions for a complete thermochemical processing process. If a process requires changes exceeding these predetermined limits or the fixed predetermined conditions of a given thermochemical processing cell the workpiece is transferred to another thermochemical processing cell providing these conditions, e.g. from thermochemical processing 1 to thermochemical processing 2 as shown in FIG. 3*a*. Dividing the thermochemical process into a plurality of steps performed under substantially constant conditions or under conditions which are only changed within a portion of the range of operating conditions for a complete thermochemical process has numerous advantages for modern thermochemical processing applications. Firstly, the combination of various different thermochemical processing steps into one set of thermochemical processing conditions for processing a workpiece allows implementation of a large number of different sets of thermochemical processing conditions using a fixed number of thermochemical processing cells being smaller than the number of sets of thermochemical processing conditions realized. Secondly, numerous sets of different thermochemical processing conditions are provided in parallel without changing operating conditions in each of the thermochemical processing cells. Thirdly, changing the operating conditions within a thermochemical processing cell requires a substantial amount of time and energy. Therefore, keeping the operating conditions in each of the thermochemical processing cells constant or varying these conditions only within a portion of the range of operating conditions for a complete thermochemical process provides considerable time as well as energy savings. Fourthly, it allows use of thermochemical processing cells, which are operable within a narrow operating range considerably reducing manufacturing costs of each of the thermochemical processing cells. Additionally, operating a thermochemical processing cell under substantially constant conditions reduces material fatigue prolonging its lifetime. Fifthly, dividing the process flow into processing steps as shown provides the means for maximizing efficiency. For example, for a given number of different thermochemical processes and a given number of workpieces per process in a given time, the processes are divided into a number of processing steps and according to the number of workpieces per processing step and time required for each processing step the number of thermochemical processing cells operating under the conditions required for each step is provided. Based on this information and using network topology based on a flow diagram as shown in FIG. 3*a* it is possible to optimize the thermal processing with respect to throughput of workpieces, efficient use of each component of the thermal processing unit, processing time, and processing energy using a processor.

Figure 3B:
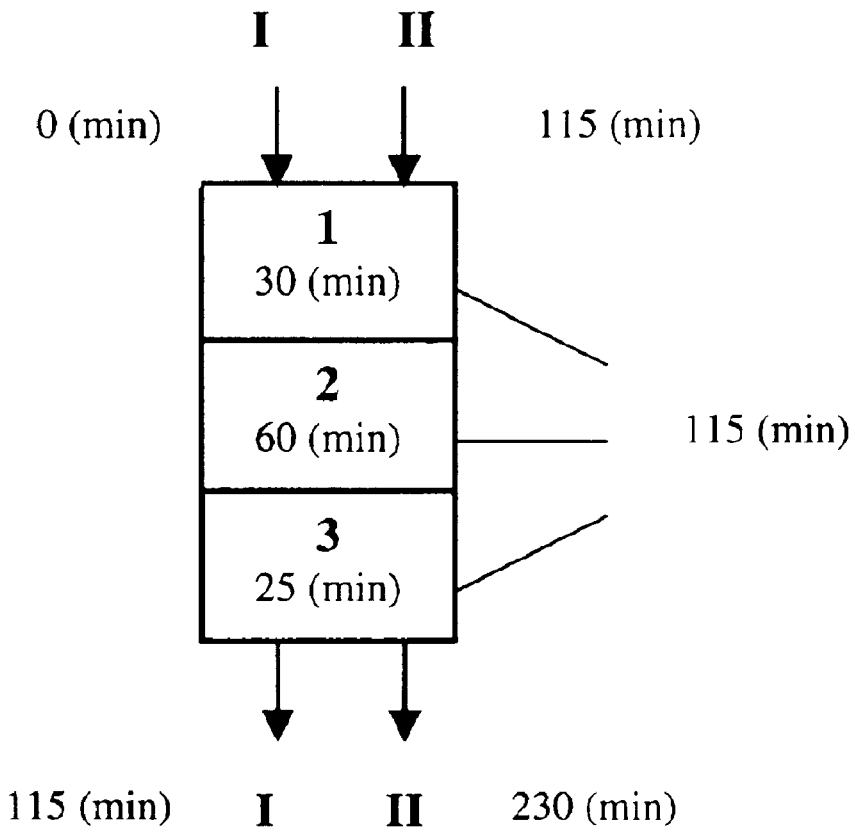
FIG. 3*b* is a simplified flow diagram illustrating a comparison of the timing of a simple process flow divided into three processing steps.
Figure 3C:
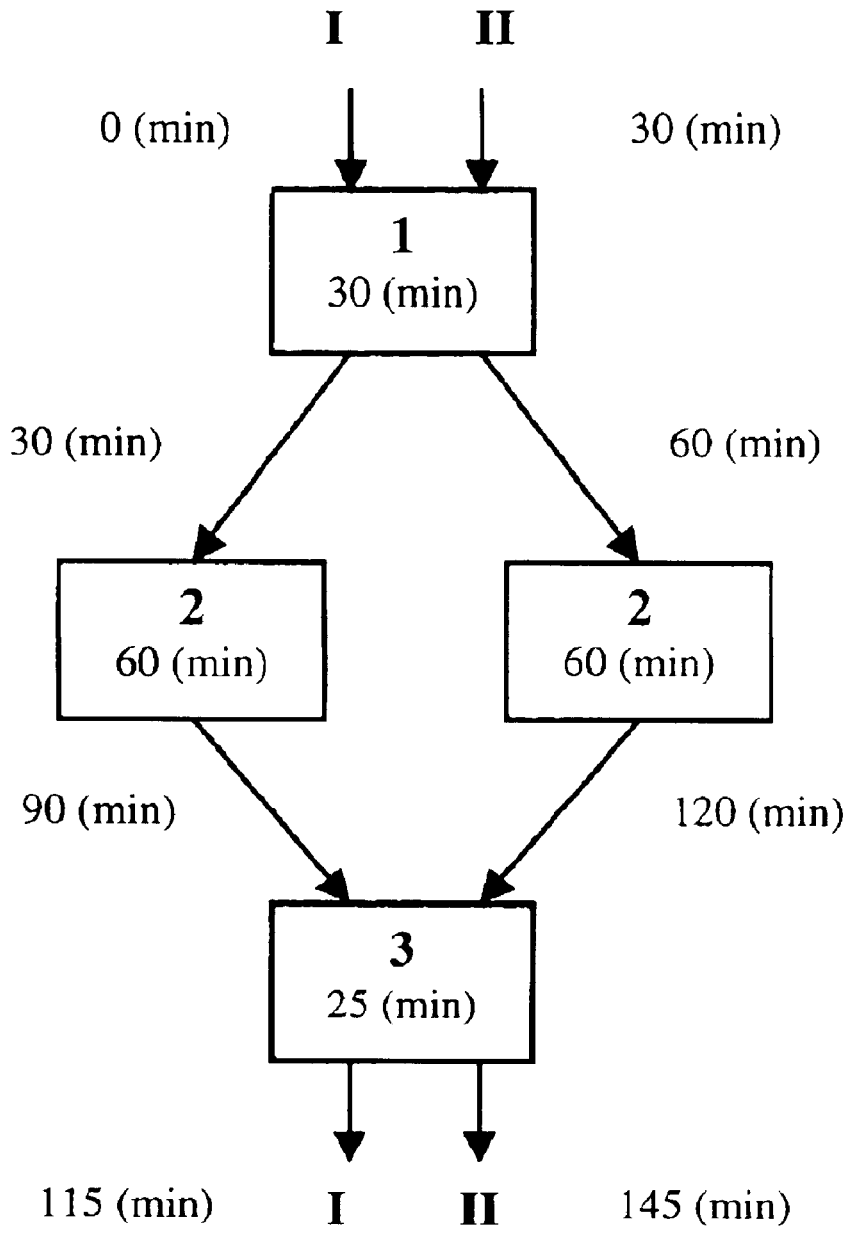
FIG. 3*c* is a simplified flow diagram illustrating a comparison of the timing of a simple process flow divided into three processing steps.

FIGS. 3*b* and 3*c* illustrate a comparison of the timing of a simple process flow divided into three processing steps, for example, a thermochemical processing step 1 requiring 30 min, followed by a thermochemical processing step 2 requiring 60 min and a thermochemical processing step 3 requiring 25 min. Provision of one thermochemical processing cell for step 1, two cells for step 2 and one cell for step 3 instead of one cell for all three steps results in considerable time savings as illustrated in FIGS. 3*b* and 3*c*. FIG. 3*b* illustrates the timing in min for the processing of two workpieces I and II. The total processing time for one workpiece is 115 min. Therefore, two workpieces are processed in 230 min. For comparison, the process flow shown in FIG. 3*c* provides workpiece I after 115 and workpiece II in 145 min, which amounts to a time saving of approximately 37%. Furthermore, for more workpieces this arrangement provides one workpiece every 30 min resulting in a substantially more constant processing flow having over twice the efficiency as the number of workpieces increases toward infinity.

Figure 4:
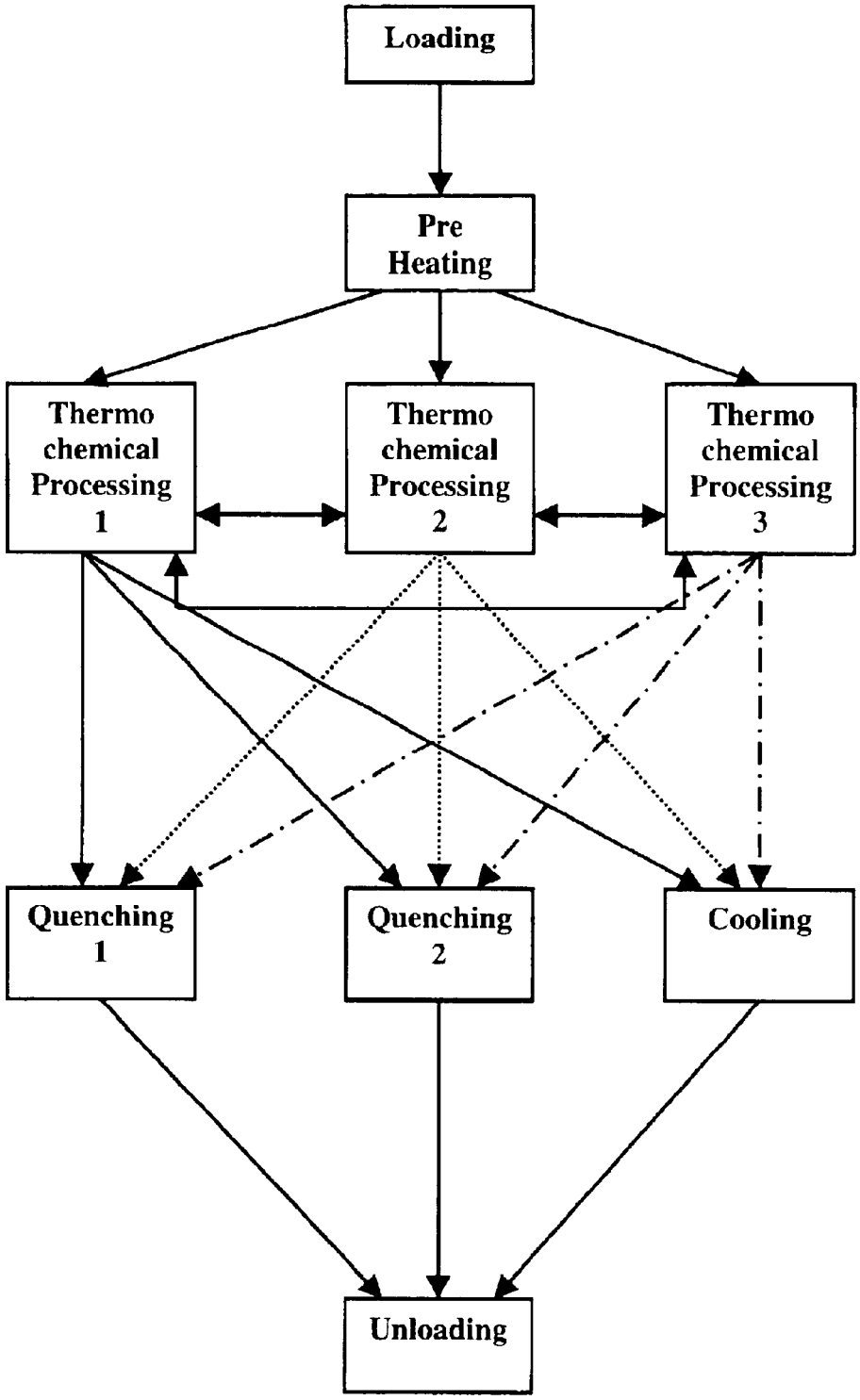
FIG. 4 is a simplified flow diagram of a method for thermal processing according to the invention.
Figure 5:
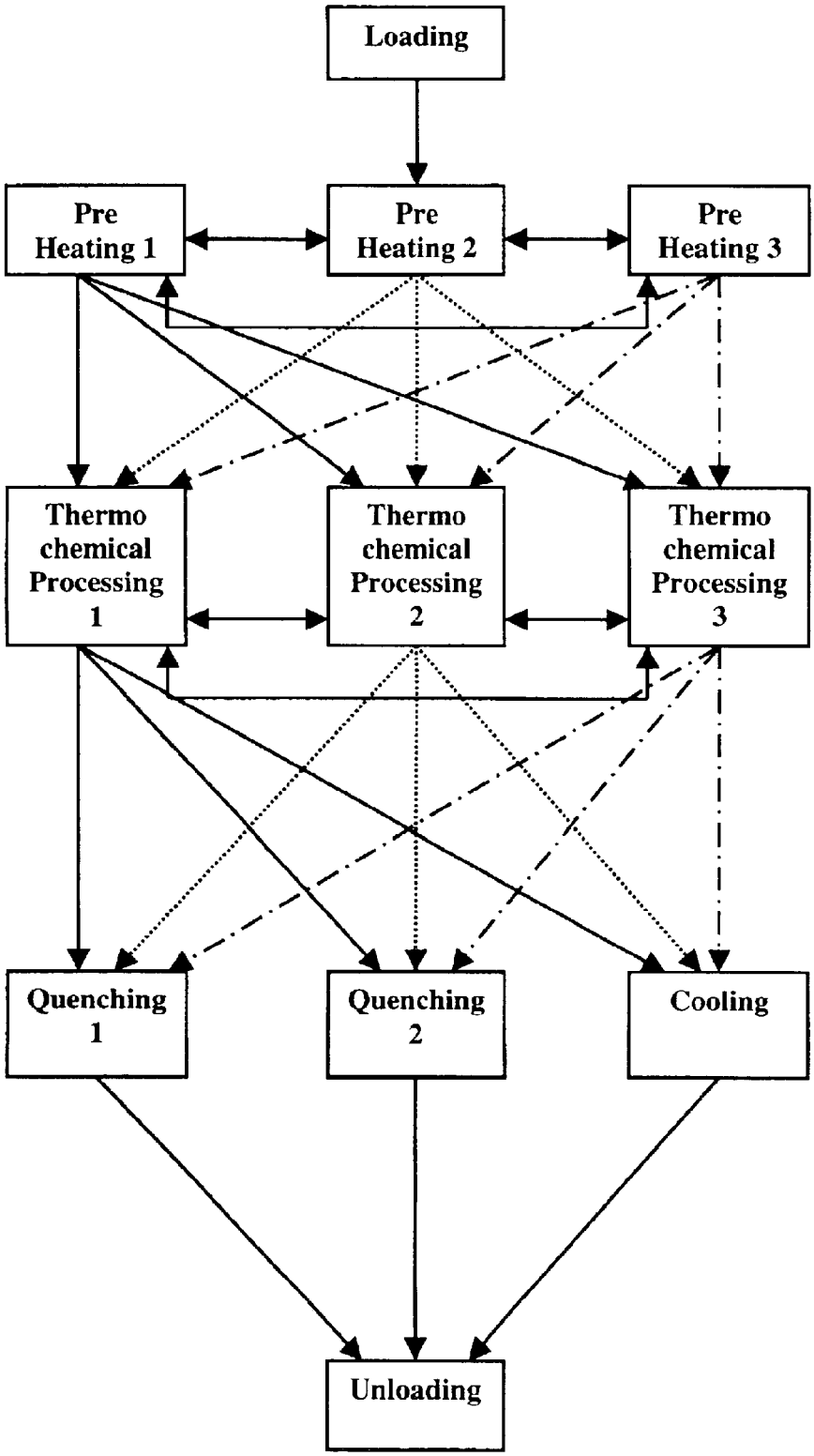
FIG. 5 is a simplified flow diagram of a method for thermal processing according to the invention.
Figure 6:
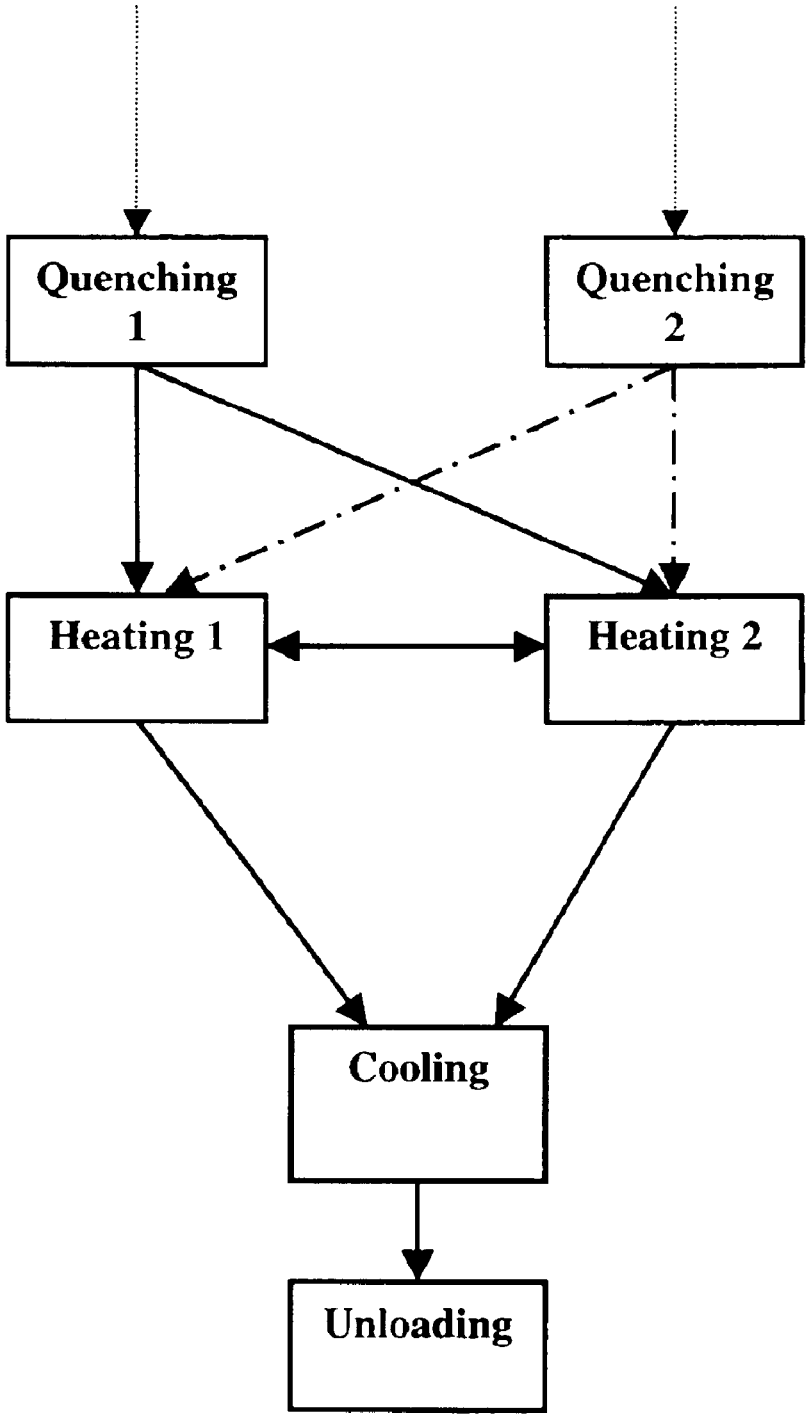
FIG. 6 is a simplified flow diagram of a method for thermal processing according to the invention.

The diagram shown in FIG. 3*a* is only a very simple example for the realization of the processing flow according to the invention. Referring to FIG. 4 flexibility is further increased by provision of different quenching steps Q1 and Q2 as well as a cooling step required for certain applications. Another option is the division of the preheating step into a plurality of preheating steps with different operating temperatures, as shown in FIG. 5. For example, workpieces requiring different preheat temperatures are provided to different preheating cells operating at different temperatures. Furthermore, it allows heating of a workpiece to a temperature T1 and then transferring the workpiece to another preheating cell for heating to a higher temperature T2. This has similar advantages as outlined above for the preheating step. FIG. 6 illustrates the implementation of further processing steps such as heating of a workpiece and slowly cooling of the workpiece after quenching in order to remove stresses in the workpiece induced by the quenching process. This treatment is referred to in the art as tempering.

Optionally, the method for thermal processing according to the invention includes thermochemical processing steps for different thermochemical processing processes combined in one processing unit and possible interconnection of same. For example, a thermochemical processing cell for nitriding is used for performing a step of a nitro-carburizing process.

Further optionally, the method for thermal processing according to the invention includes other thermal processing steps such as annealing to relieve rolling, forging, or machining strains in a workpiece before thermochemical processing and aging to recover a workpiece from unstable conditions of its structure induced by quenching.

Figure 7:
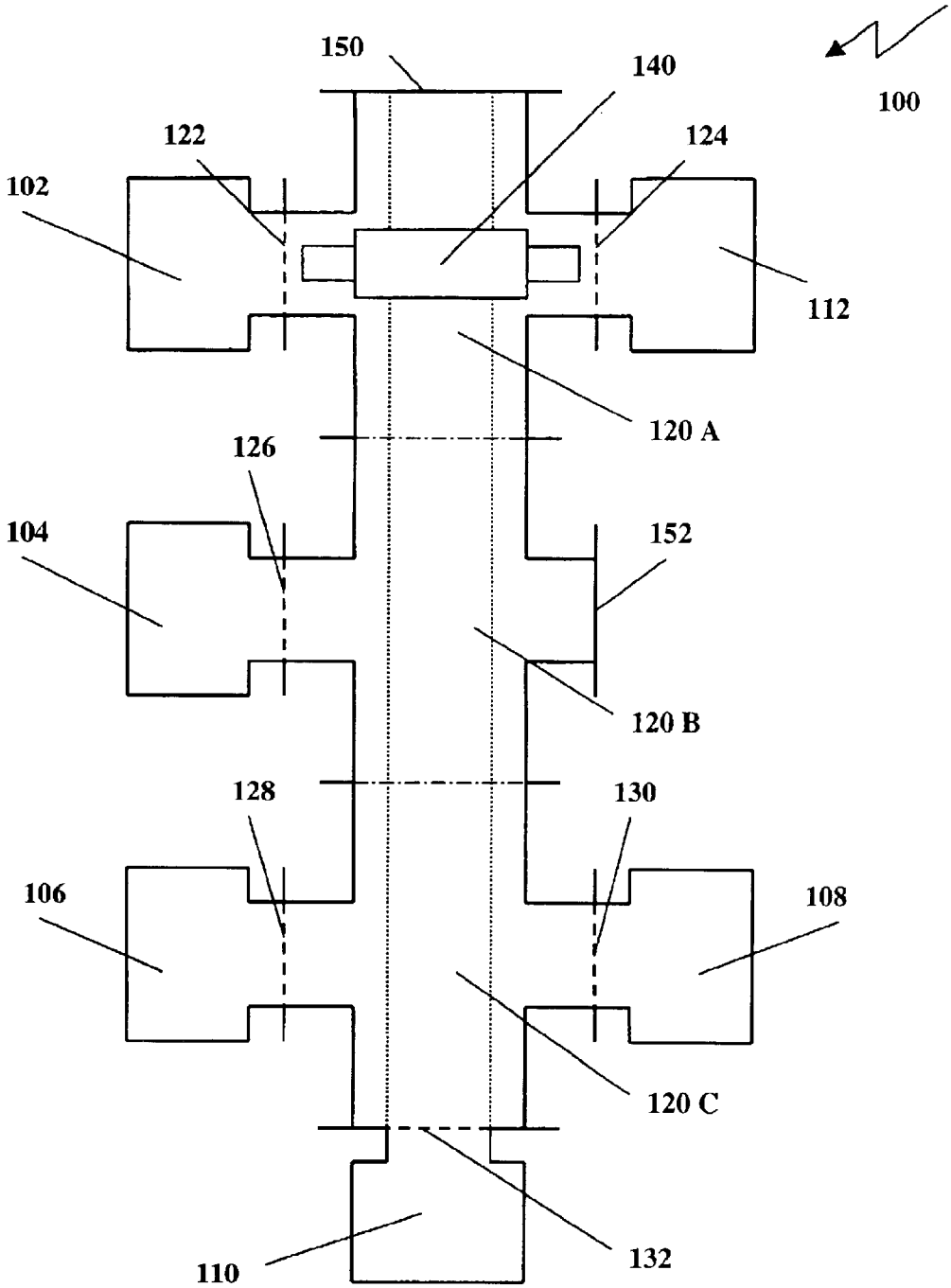
FIG. 7 is a simplified block diagram of a multi-cell thermal processing unit according to the invention.

Referring to FIG. 7 a simplified block diagram of a multi-cell thermal processing unit 100 according to the invention is shown. The thermal processing unit 100 comprises a loading cell 102 for loading and unloading workpieces, a preheating cell 104, a plurality of thermochemical processing cells—shown are three cells 106, 108, 110 but the invention is not limited thereto, and a quenching cell 112. The cells 102–112 are linked to a common gas tight chamber 120 comprising modules 120A, 120B, and 120C. Preferably, the common chamber 120 is a gas tight chamber for containing an atmosphere other than ambient air. For some applications operating in a low pressure atmosphere or allowing for gas leakage of a gas other than air an air tight common chamber 120 is sufficient. The workpieces are transferred between the various cells via transport mechanism 140 disposed within the common chamber 120. Such a transport mechanism comprises, for example, a carriage for handling the workpieces in and out of the cells, which is moved along a rail system to predetermined locations within the common chamber 120. The common chamber comprises an atmosphere other than ambient air such as a low pressure atmosphere or a high pressure atmosphere. For example, some thermochemical processes operate at pressure of approximately 5–10 mbar. Preferably, the atmosphere within the common chamber comprises substantially an inert gas such as Ar in order to reduce interference with atmospheres in the thermochemical processing cells 106–110 as well as to reduce reaction with hot surfaces of workpieces during transfer in the common chamber 120. Each of the thermochemical processing cells is operated under substantially fixed conditions for temperature, atmosphere composition and pressure. Alternatively, at least some of the conditions in some of the thermochemical processing cells 106–110 are changed during operation within a predetermined range covering only a portion of a total range of conditions required for a complete thermochemical process. For example, some nitriding processes require a gradual change of the atmosphere composition with time in order to control the nitriding potential of the atmosphere. The loading cell 102 and the quenching cell 112 are linked to the common chamber 120 via a gas tight door 122, 124 in order to avoid interaction with the low pressure atmosphere of the common chamber 120 during operation. The preheat cell 104 and the thermochemical processing cells 106–110 are linked to the common chamber via heat insulating but not gas tight doors 126–132. This is possible if the steps of preheating and thermochemical processing are performed at a same pressure, i. e. the pressure of the common chamber 120. In this case interaction of the inert gas atmosphere in the common chamber 120 with the atmospheres in the thermochemical processing cells is negligible. Use of only heat insulating doors reduces manufacturing and operating costs of the thermal processing unit 100. Optionally, some of the thermochemical processing cells 106–110 are equipped with heat insulating as well as gas tight doors if it is necessary to perform thermochemical processes at different pressures. Further optionally, the preheat cell is equipped with a heat insulating as well as gas tight door, for example, if in the preheating cell the function of activation is performed requiring the preheating cell being at least partially filled with air.

The common chamber of the multi-cell thermal processing unit 100 shown in FIG. 7 comprises 3 connected common chamber modules 120A–120C. In the example illustrated in FIG. 7 each module has 4 ports, but as is evident the invention is not limited thereto. The ports provide communication to other chamber modules as well as to the processing cells connected thereto, as shown in FIG. 7. Ports not in use are sealed with a gas tight cover 150, 152. This modular structure of the common chamber substantially increases flexibility of the multi-cell thermal processing unit 100. Firstly, it substantially facilitates provision of the processing unit tailored to a customer's needs. Secondly, it allows retrofitting of the unit in order to meet new demands, for example, adding new processing cells for providing new operating conditions or adding more processing cells operating under same conditions. New chamber modules are added to an end module of an existing unit or, alternatively, interposed between two existing modules if preferred, for example, to optimize workflow or to group similarly operating processing cells.

Figure 8:
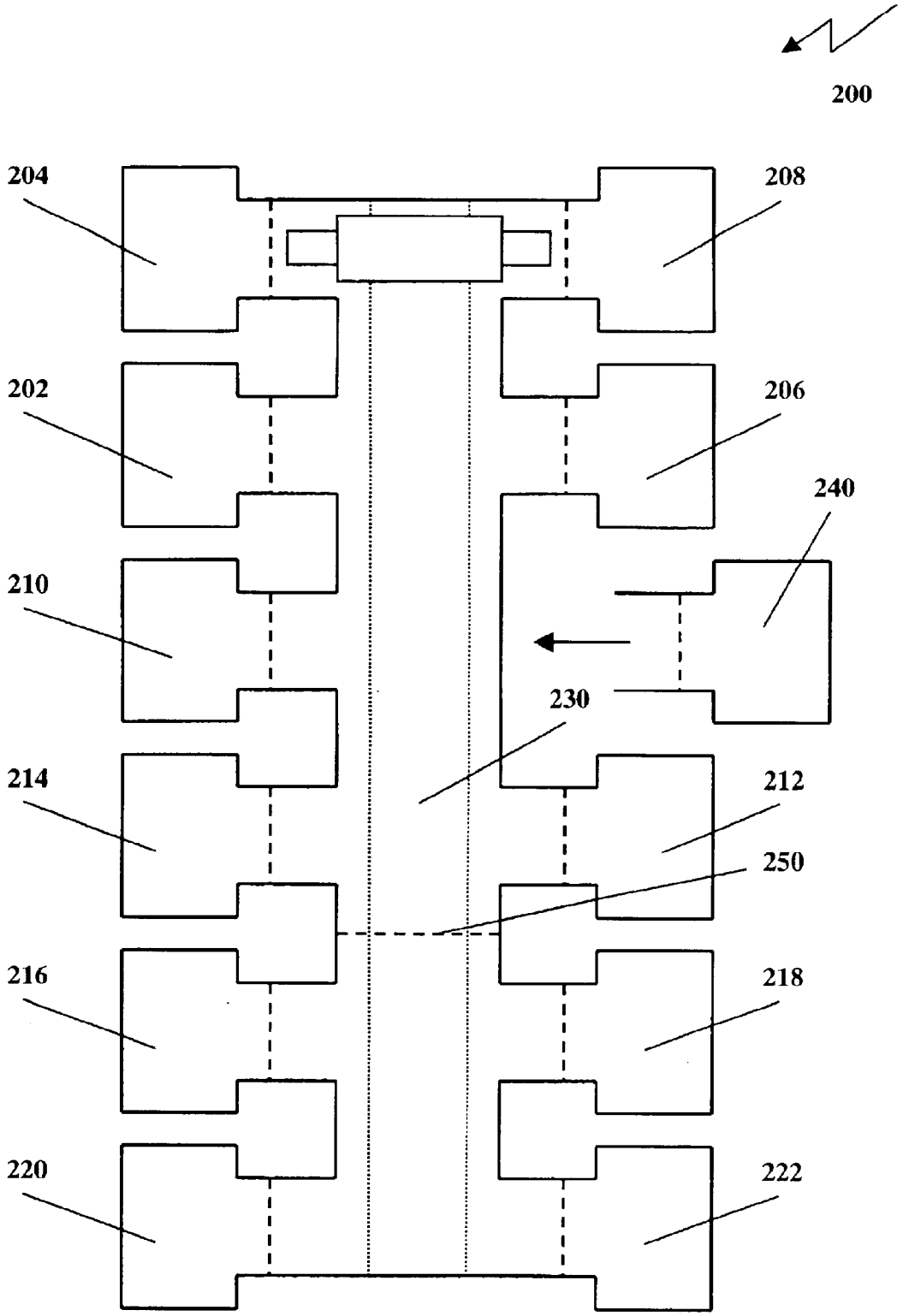
FIG. 8 is a simplified block diagram of another embodiment of a multi-cell thermal processing unit according to the invention; and, FIG. 9 is a simplified block diagram of yet another embodiment of a multi-cell thermal processing unit according to the invention.

Referring to FIG. 8 a more complex structure of a multi-cell thermal processing unit 200 according to the invention is shown. In order to provide considerably more processing flexibility more processing cells are added to the unit. Here, the unit comprises, for example, three preheating cells 210–214 operating at different substantially fixed predetermined temperatures T1–T3. This allows preheating of three workpieces at a time to different temperatures for different thermochemical processing. Furthermore, it enables preheating of workpieces in steps, for example, heating to a temperature T1, transferring to another thermochemical processing cell and heating then to a temperature T2>T1. Thermochemical processing of the workpieces is performed in thermochemical processing cells 216 to 222, similar to the unit 100 shown in FIG. 7. The thermal processing unit 200 comprises two quenching cells 204 and 206 providing, for example, means for gas quenching in one cell and oil quenching in another. Furthermore, a cooling cell 208 is provided for slowly cooling a workpiece to room temperature. All processing cells as well as loading cell 202 are linked to a common gas tight chamber 230. Optionally, all cells are arranged in groups respective to their operation. For example, grouping of thermochemical processing cells, preheat cells, quenching cells. Such grouping facilitates provision of, for example, atmosphere components to the thermochemical processing cells. Another aspect taken into consideration for the arrangement of the processing cells is minimizing transfer distances of the workpieces during thermal processing, which is, for example, achieved by locating the loading cell 202 between the quenching cells 204–206 and the preheating cells 210–214 as shown in FIG. 8. Of course numerous other arrangements as well as different numbers of cells are applicable depending upon the various thermal processes performed and the amount of workpieces to be processed. For example, if it is desired to temper some of the workpieces after quenching these workpieces are transferred to one of the preheating cells 210–214 or, alternatively, a heating cell 240 is added to the unit 200 as shown in FIG. 8.

Optionally, sections of the common chamber are separated, for example, by a gas tight door 250. For example, this allows separating the section linked to the thermochemical processing cells 216–222 from the rest of the common chamber reducing the risk of contaminating the atmospheres in the thermochemical processing cells.

Further optionally, the thermal processing unit according to invention comprises a plurality of thermochemical processing cells for providing thermochemical processing conditions for different thermochemical processing such as nitriding as well as carburizing in one thermal processing unit.

Figure 9:
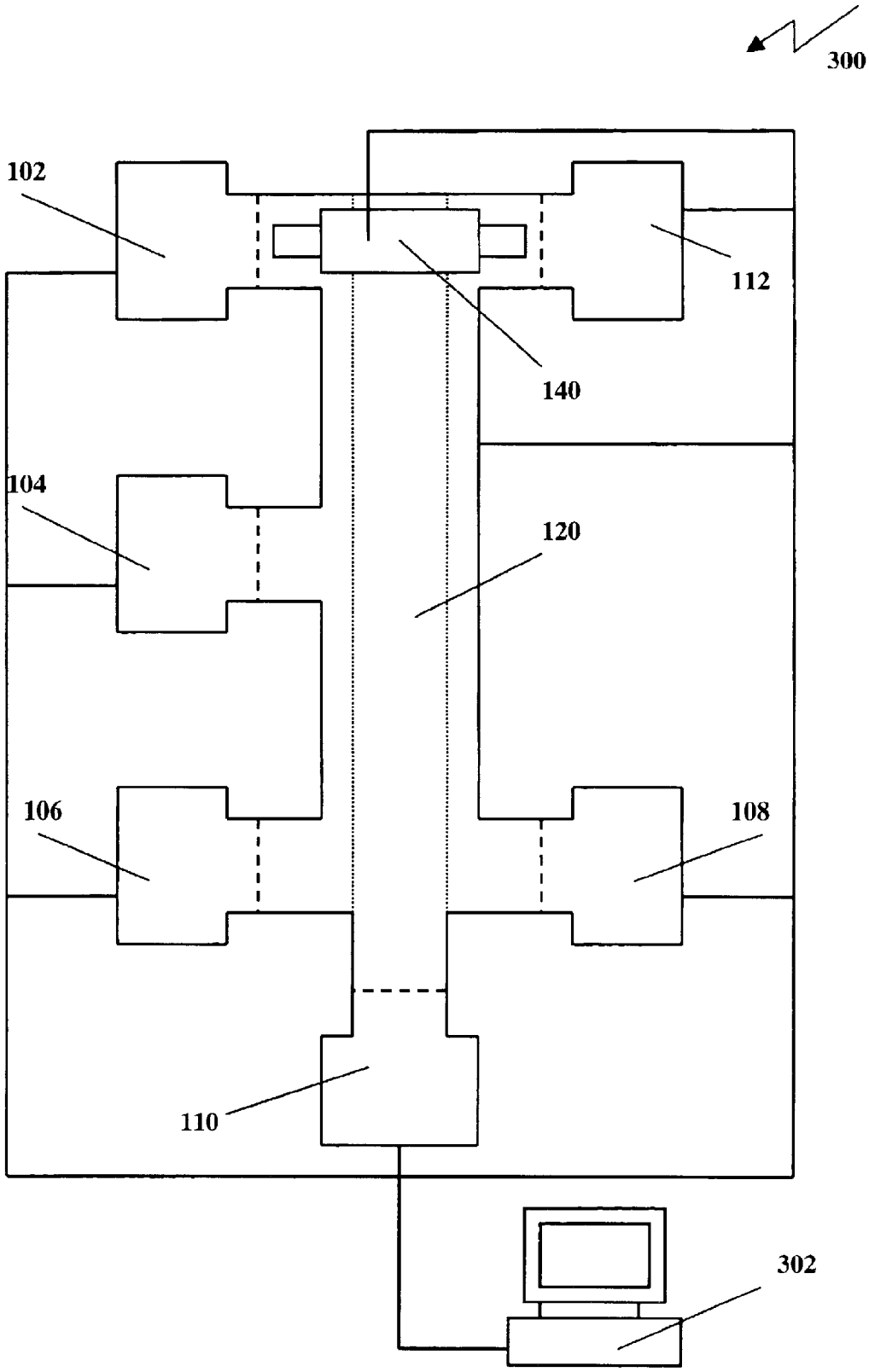

Referring to FIG. 9 an automized thermal processing unit 300 according to the invention is shown. Here, all cells 102–112, transport mechanism 140 and provision of the atmosphere in the common chamber are controlled by a computer 302. The computer control allows full integration of the thermal processing unit into a computer aided manufacturing process. Based on network topology as shown above, the available processing cells, the required thermal processes and the number of workpieces per process it is possible to determine optimum use of the thermal processing unit 300 and to control the unit accordingly using computer 302. Furthermore, if some of the processing cells are operating within a range of conditions, use of the computer 302 allows determining optimum operating conditions for each of these cells in view of required thermal processes.

The multi-cell thermal processing units according to the invention are highly advantageous for modern thermochemical processing applications. For example, changing the operating conditions within a thermochemical processing cell requires a substantial amount of time and energy. Therefore, keeping the operating conditions in each of the thermochemical processing cells constant or varying these conditions only within a range smaller than the range required for a complete thermochemical process provides considerable time as well as energy savings. Moreover, it allows use of thermochemical processing cells, which are operable within narrower operating limits considerably reducing manufacturing and operating costs of each of the thermochemical processing cells. This allows, for example, use of more cells at a same cost further increasing flexibility. Additionally, operating a thermochemical processing cell under substantially constant conditions reduces material fatigue prolonging its lifetime.

Furthermore, operating a thermochemical processing cell under substantially constant conditions considerably facilitates control functions for providing predetermined conditions. This allows a substantially more accurate control of the thermochemical processing conditions which is especially advantageous for reproducibly thermochemical processing workpieces using nitriding processes such as the NITREG® process. Therefore, the multi cell thermal processing unit according to the invention provides the potential to accurately control the conditions for each step of a complex modern nitriding process comprising the steps of activating, nitriding, post nitriding treatment and cooling. Activation of the workpiece is provided in a preheating cell providing a substantially fixed preheating temperature. The workpiece is then transferred to a first thermochemical processing cell for nitriding where the thermochemical processing conditions are provided such that a controlled nitriding potential—expressed as the ratio of ammonia and hydrogen partial pressures—is obtained. Then the workpiece is transferred to a second thermochemical processing cell for post nitriding treatment such as superficial oxidation. Finally, the workpiece is transferred to a cooling cell for controlled cooling to room temperature.

Numerous other embodiments of the invention will be apparent to persons skilled in the art without departing from the spirit and scope of the invention as defined in the appended claims.

What is claimed is:

1. A multi cell thermal processing unit comprising:

an air tight expandable common chamber module for containing an atmosphere other than ambient air, the chamber module comprising N ports;

a loading cell linked to the first port of the common chamber module via a gas tight door for providing to and receiving from the common chamber module an iron-base alloy workpiece;

a first thermochemical processing cell linked to the second port of the common chamber module via a heat insulating door for thermochemical processing the workpiece, the first thermochemical processing cell for providing substantially fixed first thermochemical processing conditions of a thermochemical process for improving material characteristics of the iron-base alloy material of the workpiece;

a second thermochemical processing cell linked to the third port of the common chamber module via a heat insulating door for thermochemical processing the workpiece, the second thermochemical processing cell for providing substantially fixed second thermochemical processing conditions of the thermochemical process;

a transport mechanism disposed within the common chamber module for handling and transporting the workpiece within the thermal processing unit;

at least a processor in control communication with the first thermochemical processing cell, the second thermochemical processing cell, and the transport mechanism for:

processing data related to the thermochemical process in order to divide the thermochemical process into at least two portions and to determine at least the first and second thermochemical processing conditions based on operational ranges of at least the first and second thermochemical processing cells for optimizing operation of the multi cell thermal processing unit;

controlling provision of the first and the second thermochemical processing conditions; and, controlling handling and transportation of the workpiece within the thermal processing unit; and, N-3 sealing covers for airtightly sealing the remaining N-3 ports, the covers being removable for mating the common chamber module to a processing cell or another common chamber module.

2. A multi cell thermal processing unit as defined in claim 1, comprising:

a second common chamber module having N ports, the first port of the second chamber module being connected to a fourth port of the common chamber module for providing transport communication therebetween;

a third thermochemical processing cell linked to the second port of the second common chamber module via a heat insulating door, the third thermochemical processing cell for providing substantially fixed third thermochemical processing conditions; and, N-2 sealing covers for airtightly sealing the remaining N-2 ports, the covers being removable for mating the second common chamber module to a processing cell or another common chamber module.

3. A multi cell thermal processing unit as defined in claim 2, comprising a control communication link between the third thermochemical processing cell and the at least a processor, the at least a processor for controlling provision of the third thermochemical processing conditions, wherein the substantially fixed third thermochemical processing conditions are a third portion of the thermochemical process.

4. A multi cell thermal processing unit as defined in claim 2, comprising a fourth thermochemical processing cell linked to the third port of the second common chamber module via a heat insulating door, the fourth thermochemical processing cell for providing substantially fixed fourth thermochemical processing conditions.

5. A multi cell thermal processing unit comprising:

an air tight common chamber for containing an atmosphere other than ambient air;

a loading cell linked to the common chamber via a gas tight door for providing to and receiving from the common chamber an iron-base alloy workpiece;

a first thermochemical processing cell linked to the common chamber via a heat insulating door for thermochemical processing the workpiece, the first thermochemical processing cell for providing substantially fixed first thermochemical processing conditions of a thermochemical process for improving material characteristics of the iron-base alloy material of the workpiece;

a second thermochemical processing cell linked to the common chamber via a heat insulating door for thermochemical processing the workpiece, the second thermochemical processing cell for providing substantially fixed second thermochemical processing conditions of the thermochemical process;

a transport mechanism disposed within the common chamber for handling and transporting the workpiece within the thermal processing unit; and, at least a processor in control communication with the first thermochemical processing cell, the second thermochemical processing cell, and the transport mechanism for:

processing data related to the thermochemical process in order to divide the thermochemical process into at least two portions and to determine at least the first and second thennochemical processing conditions based on operational ranges of at least the first and second thermochemical processing cells for optimizing operation of the multi cell thermal processing unit;

controlling provision of the first and the second thermochemical processing conditions; and, controlling handling and transportation of the workpiece within the thermal processing unit.

6. A multi cell thermal processing unit as defined in claim 5, comprising a control communication link between the air tight common chamber and the at least a processor, the at least a processor for controlling provision of the atmosphere within the common chamber, the atmosphere substantially comprising an inert gas.

7. A multi cell thermal processing unit comprising:

an air tight common chamber for containing an atmosphere other than ambient air;

a loading cell linked to the common chamber via a gas tight door for providing to and receiving from the common chamber an iron-base alloy workpiece;

a first thermochemical processing cell linked to the common chamber via a heat insulating door for thermochemical processing the workpiece, the first thermochemical processing cell for providing substantially fixed first thermochemical processing conditions of a thermochemical process for improving material characteristics of the iron-base alloy material of the workpiece;

a second thermochemical processing cell linked to the common chamber via a heat insulating door for thermochemical processing the workpiece, the second thermochemical processing cell for providing substantially fixed second thermochemical processing conditions of the thermochemical process;

a transport mechanism disposed within the common chamber for handling and transporting the workpiece within the thermal processing unit; and, at least a processor in control communication with the first thermochemical processing cell, the second thermochemical processing cell, and the transport mechanism for:

processing data related to the thermochemical process in order to divide the thermochemical process into at least two portions and to determine at least the first and second thermochemical processing conditions based on operational ranges of at least the first and second thermochemical processing cells for optimizing operation of the multi cell thermal processing unit;

controlling provision of a first atmosphere composition and a first temperature of the first thermochemical processing conditions, and a second atmosphere composition and a second temperature of the second thermochemical processing conditions; and, controlling handling and transportation of the workpiece within the thermal processing unit.

8. A multi cell thermal processing unit as defined in claim 7, comprising a control communication link between the air tight common chamber and the at least a processor, the at least a processor for controlling provision of the atmosphere within the common chamber, the atmosphere substantially comprising an inert gas.

9. A multi cell thermal processing unit as defined in claim 8, comprising a third thermochemical processing cell linked to the common chamber via a heat insulating door, the third thermochemical processing cell for providing third thermochemical processing conditions of the thermochemical process.

10. A multi cell thermal processing unit as defined in claim 9, wherein the heat insulating door of at least one of the thermochemical processing cells is also a gas tight door.

11. A multi cell thermal processing unit as defined in claim 8, comprising a preheating cell linked to the common chamber via a heat insulating door, the preheating cell for providing a substantially fixed temperature for heating the workpiece to a predetermined temperature.

12. A multi cell thermal processing unit as defined in claim 11, comprising a second other preheating cell linked to the common chamber via a heat insulating door, the second other preheating cell for providing a substantially fixed second other temperature for heating the workpiece to a predetermined second other temperature.

13. A multi cell thermal processing unit as defined in claim 11, comprising a quenching cell linked to the common chamber via a gas tight door, the quenching cell for providing a predetermined quenching operation for the workpiece.

14. A multi cell thermal processing unit as defined in claim 13, comprising a second other quenching cell linked to the common chamber via a gas tight door, the second other quenching cell for providing a second other predetermined quenching operation.

15. A multi cell thermal processing unit as defined in claim 11, comprising a heating cell linked to the common chamber via a heat insulating door, the heating cell for providing heating of the workpiece to a predetermined temperature after quenching.

16. A multi cell thermal processing unit as defined in claim 15, comprising a cooling cell linked to the common chamber, the cooling cell for cooling the workpiece.

17. A multi cell thermal processing unit comprising:

an air tight common chamber for containing an atmosphere substantially comprising an inert gas;

a loading cell linked to the common chamber via a gas tight door for providing to and receiving from the common chamber an iron-base alloy workpiece;

a first thermochemical processing cell linked to the common chamber for thermochemical processing the workpiece, the first thermochemical processing cell for providing first thermochemical processing conditions of a thermochemical process for improving material characteristics of the iron-base alloy material of the workpiece;

a second thermochemical processing cell linked to the common chamber for thermochemical processing the workpiece, the second thermochemical processing cell for providing second thermochemical processing conditions of the thermochemical process;

a transport mechanism disposed within the common chamber for handling and transporting the workpiece within the thermal processing unit; and, at least a processor in control communication with the first thermochemical processing cell, the second thermochemical processing cell, and the transport mechanism for:

processing data related to the thermochemical process in order to divide the thermochemical process into at least two portions and to determine at least the first and second thermochemical processing conditions based on operational ranges of at least the first and second thermochemical processing cells for optimizing operation of the multi cell thermal processing unit, wherein the at least first and second thermochemical processing conditions are variable within ranges smaller than total ranges of the processing conditions of the thermochemical process;

controlling provision of the first and the second thermochemical processing conditions; and, controlling handling and transportation of the workpiece within the thermal processing unit.

18. A multi cell thermal processing unit as defined in claim 17, comprising a preheating cell linked to the common chamber via a heat insulating door, the preheating cell for providing a substantially fixed temperature for heating the workpiece.

19. A method for thermal processing a workpiece comprising:

dividing a thermochemical process for improving material characteristics of an iron-base alloy material of the workpiece into at least two portions and determining corresponding thermochemical processing conditions based on operational ranges of at least two thermochemical processing cells, wherein the determined corresponding thermochemical processing conditions are variable within ranges smaller than total ranges of the processing conditions of the thermochemical process;

providing the workpiece to a first thermochemical processing cell linked to a common chamber containing an atmosphere other than ambient air;

thermochemical processing the workpiece by providing first thermochemical processing conditions of the thermochemical process;

transferring via the common chamber the workpiece from the first thermochemical processing cell to a second thermochemical processing cell linked to the common chamber after elapse of a first predetermined time interval;

thermochemical processing the workpiece by providing second thermochemical processing conditions of the thermochemical process; and, removing the workpiece from the second thermochemical processing cell after elapse of a second predetermined time interval.

20. A method for thermal processing a workpiece as defined in claim 19, comprising:

providing a second workpiece to the first thermochemical processing cell after transferring the workpiece to the second thermochemical processing cell; and, thermochemical processing the second workpiece by providing the first thermochemical processing conditions of the thermochemical process.

21. A method for thermal processing a workpiece as defined in claim 19, comprising:

transferring via the common chamber the workpiece from the second thermochemical processing cell to a third thermochemical processing cell linked to the common chamber;

thermochemical processing the workpiece by providing third thermochemical processing conditions of the thermochemical process; and, removing the workpiece from the third thermochemical processing cell after elapse of a third predetermined time interval.

22. A method for thermal processing a workpiece as defined in claim 21, wherein at least one of the determined thermochemical processing conditions is substantially fixed.

23. A method for thermal processing a workpieee as defined in claim 21, comprising:

providing the workpiece to a preheating cell linked to the common chamber; and, preheating the workpiece to a predetermined temperature.

24. A method for thermal processing a workpiece as defined in claim 23, comprising:

transferring via the common chamber the workpiece from the preheating cell to a second preheating cell linked to the common chamber; and, preheating the workpiece to a second predetermined temperature.

25. A multi cell thermal processing unit comprising:

an air tight common chamber for containing an atmosphere other than ambient air;

a loading cell linked to the common chamber via a gas tight door for providing to and receiving from the common chamber an iron-base alloy workpiece;

a first thermochemical processing cell linked to the common chamber via a heat insulating door for thermochemical processing the workpiece, the first thermochemical processing cell for providing substantially fixed first thermochemical processing conditions of a thermochemical process for improving material characteristics of the iron-base alloy material of the workpiece;

a second thermochemical processing cell linked to the common chamber via a heat insulating door for thermochemical processing the workpiece, the second thermochemical processing cell for providing substantially fixed second thermochemical processing conditions of the thermochemical process;

a transport mechanism disposed within the common chamber for handling and transporting the workpiece within the thermal processing unit; and, at least a processor in control communication with the first thermochemical processing cell, the second thermochemical processing cell, and the transport mechanism for:

processing data related to the thermochemical process in order to divide the thermochemical process into at least two portions and to determine at least the first and second thermochemical processing conditions based on operational ranges of at least the first and second thermochemical processing cells for optimizing operation of the multi cell thermal processing unit, wherein the at least first and second thermochemical processing conditions are variable within ranges smaller than total ranges of the processing conditions of the thermochemical process;

controlling provision of the first and the second thermochemical processing conditions, wherein at least one of the first and the second thermochemical processing conditions comprises a predetermined potential corresponding to the thermochemical process; and, controlling handling and transportation of the workpiece within the thermal processing unit.

26. A multi cell thermal processing unit as defined in claim 25, comprising:

a third thermochemical processing cell linked to the common chamber via a heat insulating door, the third thermochemical processing cell for providing third thermochemical processing conditions of the thermochemical process.

27. A multi cell thermal processing unit as defined in claim 26, wherein the heat insulating door of at least one of the thermochemical processing cells is also a gas tight door.

28. A multi cell thermal processing unit as defined in claim 5, wherein the thermochemical process is one of nitriding, carburizing, carbo-nitriding, and nitro-carburizing.

29. A multi cell thermal processing unit as defined in claim 17, wherein the thermochemical process is one of nitriding, carburizing, carbo-nitriding, and nitro-carburizing.

30. A multi cell thermal processing unit as defined in claim 19, wherein the thermochemical process is one of nitriding, carburizing, carbo-nitriding, and nitro-carburizing.

* * * * *